United States Patent [19]

Staroselsky et al.

[11] Patent Number: 4,949,276

[45] Date of Patent: Aug. 14, 1990

[54] METHOD AND APPARATUS FOR PREVENTING SURGE IN A DYNAMIC COMPRESSOR

[75] Inventors: Naum Staroselsky, Des Moines; Saul Mirsky, West Des Moines; Paul A. Reinke, Des Moines, all of Iowa

[73] Assignee: Compressor Controls Corp., Des Moines, Iowa

[21] Appl. No.: 263,172

[22] Filed: Oct. 26, 1988

[51] Int. Cl.[5] ..... F04D 27/02; G04B 13/02

[52] U.S. Cl. ..... 364/509; 364/510; 364/431.02; 415/1; 415/17

[58] Field of Search ..... 364/509, 510, 558, 431.02; 415/1, 27, 11, 17; 417/19, 20, 26, 47; 62/228.3; 73/168, 199, 861.42, 861.44

[56] References Cited

U.S. PATENT DOCUMENTS

| | | | |
|---|---|---|---|
| 4,046,490 | 9/1977 | Rutshtein et al. | 417/47 |
| 4,139,328 | 2/1979 | Kuper et al. | 415/1 |
| 4,142,838 | 3/1979 | Staroselsky | 417/20 |
| 4,164,033 | 8/1979 | Glennon et al. | 415/17 |
| 4,355,948 | 10/1982 | Kountz et al. | 415/1 |
| 4,486,142 | 12/1984 | Staroselsky | 415/1 |
| 4,594,050 | 6/1986 | Gaston | 415/1 |
| 4,627,788 | 12/1986 | Keyes, IV et al. | 415/11 |
| 4,697,980 | 10/1987 | Keyes, IV et al. | 415/1 |
| 4,749,331 | 6/1988 | Blotenberg | 415/1 |
| 4,781,524 | 11/1988 | Blotenberg | 415/1 |
| 4,807,150 | 2/1989 | Hobbs | 364/510 |
| 4,831,534 | 5/1989 | Blotenberg | 364/431.02 |
| 4,831,535 | 5/1989 | Blotenberg | 415/1 |

OTHER PUBLICATIONS

"Digital Anti Surge Controls, Their Advantages–Their Limits", Dipl. Ing., Wilfried Blotenberg.

"Electronic Anti-Surge Control System, Turbolog EKU 180", Basic Control System Manual, Blotenberg.

*Primary Examiner*—Felix D. Gruber

*Assistant Examiner*—Christopher L. Makay

*Attorney, Agent, or Firm*—Henderson & Sturm

[57] ABSTRACT

A method is disclosed for efficiently protecting dynamic compressors from surge under changing inlet conditions and in response to flow disturbances of varying size and speed. An antisurge control system based on this disclosed method will compute the relative proximity of the compressor operating point to its surge limit as a multi-variable parameter which is self-compensated for changes in gas composition, inlet temperature and pressure, compressor efficiency, guide-vane position, and rotational speed. A combination of adaptive closed- and open-loop control responses is used to maintain a margin of safety between the operating point and the surge limit. Both the safety margin and the magnitude of the open-loop response are proportional to the rate at which the operating point approaches the surge limit, thus maximizing process efficiency.

4 Claims, 2 Drawing Sheets

METHOD AND APPARATUS FOR PREVENTING SURGE IN A DYNAMIC COMPRESSOR

Technical Field

The present invention relates generally to a method and apparatus for protecting dynamic compressors from surge, and more particularly to a control system and method which combines both closed and open loop responses, where both the magnitudes of both responses vary with the rate at which the compressor operating point approaches the surge limit line, thus tailoring the total control response to a wide range of disturbances.

Background Art

As is well known, changing process conditions may reduce the volumetric flow through a dynamic compressor below the minimum rate required for stable operation, resulting in surge. To prevent this damaging phenomenon, the compressor's control system must maintain the flow rate through the compressor at a sufficiently high level to enable its control algorithms to respond to any disturbance before the flow rate can fall below the surge limit. This is achieved by recycling or blowing off a portion of the gas stream whenever the flow rate is at or below this desired margin of safety.

Setting the margin of safety too low will provide inadequate protection against surge. On the other hand, increasing the magnitude of the margin of safety will increase the frequency and duration of recycling, thus reducing the overall energy efficiency of the compression process. Considerable advantage can thus be gained by improving the control algorithms to provide adequate surge protection with a smaller margin of safety. The conditions under which surge will occur are considerably influenced by changes of the gas molecular weight, specific heat ratio, and compressor efficiency. Previously available antisurge control methods fail to account for such changes, thus requiring a larger margin of safety to achieve full protection under all possible operating conditions.

The method of this invention overcomes this limitation by calculating the distance between the compressor operating point and surge limit as a unique function of the inlet and discharge temperatures and pressures, the volumetric feed rate and (in the case of variable speed and/or variable guide vane compressors) the rotational speed and guide vane position. The resulting parameter is invariant to all compressor operating conditions, including those (such as molecular weight, specific heat ratio and polytropic efficiency) which are difficult or impossible to measure on line.

Previously available antisurge control methods also either lack the ability to tailor their control responses to disturbances of varying size and speed, or do so in a manner which can produce unnecessary recycling or leave the compressor vulnerable to surge.

Stability considerations preclude a proportional-plus-integral control response from preventing surge due to fast disturbances, unless the margin of safety is larger than needed for slow upsets, thus sacrificing energy efficiency. The well-known proportional-integral-derivative control algorithm yields a faster response but is unsuitable for antisurge control because its derivative component will open the antisurge valve even when the compressor is operating far from its surge limit.

Previously available antisurge controllers have attempted to overcome this limitation by making the gain of the proportional-plus-integral algorithm a function of the magnitude of the error, the derivative of the error, or both. However, stability considerations prevent such schemes from preventing surge unless a larger margin of safety is provided or the variable-gain feature operates only in one direction.

Systems which employ the latter approach do so by using valve positioners which open the valve quickly but close it at a much slower rate. However, that method leaves the compressor vulnerable to surge if another disturbance occurs while the valve is closing. Under such conditions, the valve position will not correspond to the output of the controller—it will in fact be farther open. Because the controller's response to the new disturbance will be based on false assumptions about the valve position, it could easily prove insufficient to prevent surge.

For this reason, the present invention uses modified control algorithms (rather than external hardware modifications) to accomplish the same objective without risking surge in the event of successive disturbances.

Another way to overcome the stability limitations of closed-loop control algorithms is to use an open-loop response to implement an additional step-change in the antisurge valve opening when the disturbance proves too large for the closed-loop response to handle. However, this approach is subject to the same stability considerations as a variable-gain closed-loop algorithm. Also, an open-loop response large enough to protect against fast disturbances will unnecessarily distort the process in response to smaller disturbances. Making the size of the open-loop response a function of the rate at which the compressor is approaching surge and then allowing this added response to slowly decay to zero when moving away from surge will overcome both of these limitations.

A previous patent granted to Staroselsky (U.S. Pat. No. 4,142,838) covered a method of preventing surge which was based on controlling the ratio of the pressure increase across the compressor to the pressure drop across a flow measuring device. That method prevented surge by employing a closed-loop proportional-plus-integral response in combination with a open-loop response of fixed magnitude. Further protection was provided by making step changes to the set points of both the closed- and open-loop responses whenever a surge occurred. The operation of the antisurge control system presented in that earlier patent was not self-adjusting for changes in gas composition and compressor efficiency, nor were its control responses dependent on the rate at which the compressor's operating point approached its surge limit. The present invention improves on that earlier method by:

- computing the distance between the compressor operating point and the surge limit as a multi-variable parameter self-compensated for broad changes of gas composition and compressor efficiency;
- calculating the closed-loop set point as a function of the rate at which the operating point approaches the surge limit and then allowing that set point to decay to a steady-state value when the operating point moves away from the surge limit; and
- calculating the magnitudes of the open-loop responses as a function of the rate at which the operating point approaches the surge limit and then allowing that open-loop response to decay to zero when the operating point moves away from the surge limit.

Disclosure of the Invention

The main purpose of this invention is provide an improved method of preventing dynamic compressors from surging without unnecessarily sacrificing overall process efficiency or disrupting the process using the compressed gas. The main advantages of this invention are that it maximizes overall process efficiency, compressor and process reliability, and the effectiveness of antisurge protection. These advantages expand the operational envelope of the dynamic compressor.

One object of this invention is to gauge the relative proximity of the compressor operating point to its surge limit, in a manner which is invariant to changes in gas composition, inlet pressure and temperature, compressor efficiency, guide-vane position, and rotational speed.

Toward this object, this invention measures the distance between the operating point and surge limit as a multi-variable parameter computed as a function of compressor discharge and inlet pressure, discharge and inlet temperature, the pressure differential across a flow measuring device, the compressor's rotational speed and the position of its guide vanes. As the compressor's operating point approaches the surge limit, this parameter monotonically approaches a unique value which is the same for all inlet and operating conditions.

In order to protect the compressor from surge, this invention manipulates the compressor flow rate so as to maintain an adequate margin of safety between the operating point and surge limit, which is calculated as a function of the above described multi-variable parameter.

As is well known, opening the antisurge valve increases the compressor flow rate by recycling or blowing off an additional stream of process gas. The energy used to compress this gas is wasted, thus compromising process efficiency.

A second object of this invention is to optimize this inherent trade-off between surge protection and process efficiency.

Toward this second object, this invention tailors the magnitude of the margin of safety to the rate at which the operating point approaches the surge limit, as defined by the rate of change of the above described multi-variable parameter. When the operating point is moving toward surge, the margin of safety will reflect the highest value that derivative has obtained. When the operating point moves away from surge, the margin of safety will be slowly decreased to a preset minimum level. The advantage of this method is that the antisurge valve is not opened any sooner or any farther than necessary to prevent any given disturbance from causing surge, thus maximizing process efficiency under all conditions.

In order to further optimize the compromise between surge protection and process efficiency, this invention calculates the magnitude of the antisurge valve opening as a combination of closed-loop and open-loop responses. For small disturbances, in which the distance between the operating point and surge limit drops only slightly below the desired margin of safety, only the closed-loop response is used.

For large disturbances, in which the distance between the operating point and surge limit drops far below the desired margin of safety, the open-loop response is used to quickly increase the flow rate. When that distance deviates below a preset danger threshold, the open-loop response triggers a step increase in the valve opening. This open-loop response is repeated at preset time intervals, as long as the compressor operating point remains beyond the danger threshold.

Opening the antisurge valve further than necessary to prevent a given disturbance from causing a surge will disrupt the process which uses the compressed gas. Thus, 0 the magnitude of the open-loop response is a compromise between protecting the compressor from large disturbances and minimizing the resulting process disruptions.

A third object of this invention is to optimize this inherent trade-off between surge protection and process disruption.

Toward this third object, this invention tailors the magnitude of each open-loop response step to the instantaneous rate at which the operating point is approaching the surge limit, as defined by the rate of change of the above described multi-variable parameter.

The advantage of this method is that the open-loop response opens the antisurge valve only as far as necessary to prevent any given disturbance from causing surge, thus minimizing the resulting process disruption.

Other objects, advantages and novel features of the invention, will become apparent from the following detailed description of the invention when considered in conjunction with the accompanied drawings.

Best Method of Implementing the Invention

Figure 1:
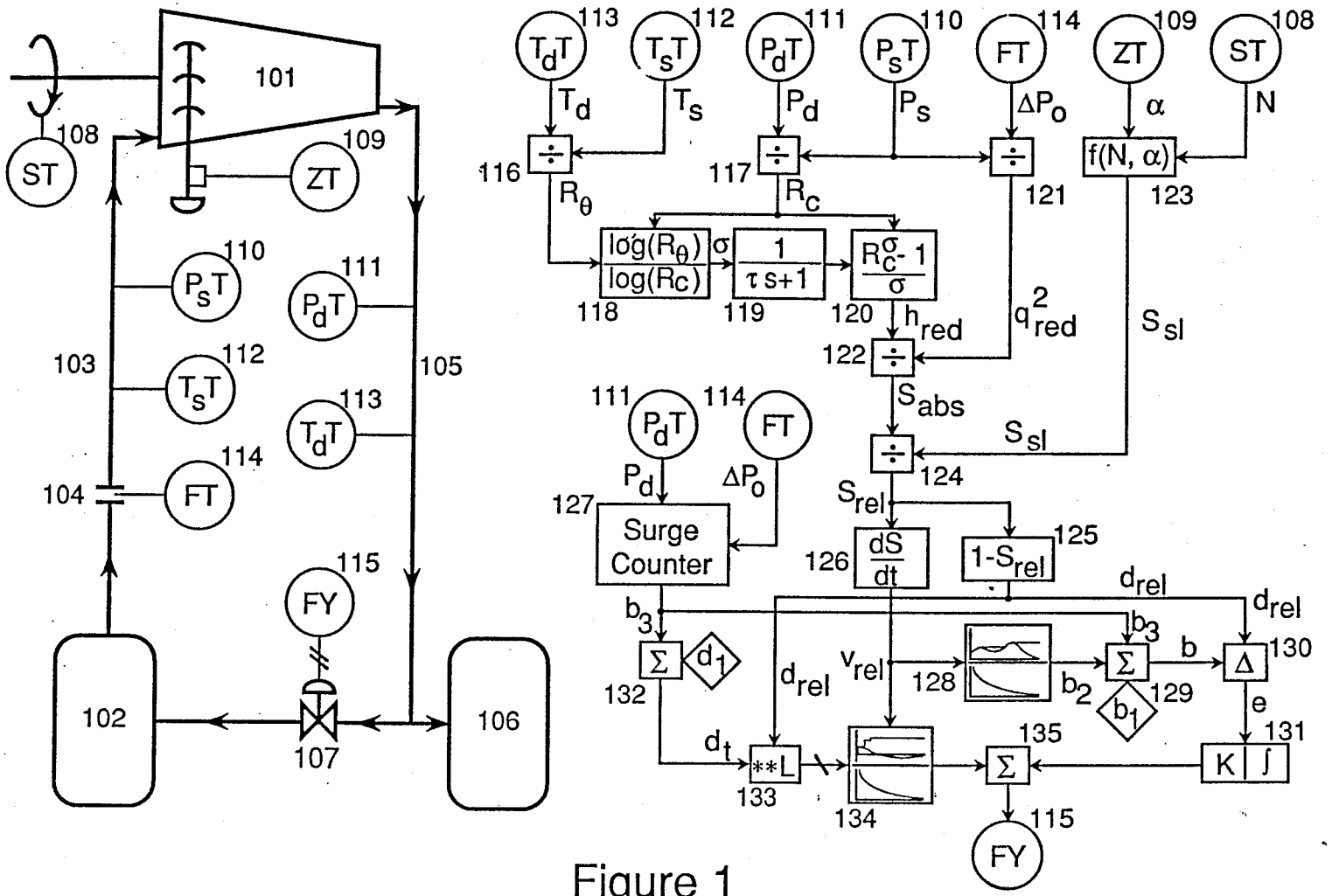
FIG. 1 is a schematic diagram of a dynamic compressor and a surge protection system.

It is well known that dynamic compression is achieved by increasing the specific mechanical energy (polytropic head) of a gas stream. This increase in polytropic head ($H_p$) can be calculated as:

$$H_p = B \times \frac{R_c^{\sigma} - 1}{\sigma} \times \frac{T_s Z_{av}}{MW} \quad (1)$$

where:

B is a proportionality constant, $R_c$ is the compression ratio, $\sigma$ is the polytropic exponent, $T_s$ is the suction temperature, MW is the molecular weight, and $Z_{av}$ is the average compressibility factor.

It is also well known that this increase in polytropic head is a function of the volumetric flow in suction ($Q_s$) only, which can be calculated as:

$$Qs = A\sqrt{\frac{\Delta P_o}{P_s} \times \frac{T_s \times Z_s}{MW}} \quad (2)$$

where:

A is a constant coefficient, $\Delta P_o$ is the pressure differential across the flow measuring device, $P_s$ is the suction temperature, and $Z_s$ is the compressibility factor under suction conditions.

The ratio of $H_p$ to $Q_s^2$ can thus be computed without measuring the molecular weight. If we assume compressibility effects are negligible, we can show that:

$$\frac{H_p}{Q_2^s} \propto \frac{\frac{R_c^{\sigma}-1}{\sigma} \times \frac{T_s \times Z_{av}}{MW}}{\frac{\Delta P_o}{P_s} \times \frac{T_s \times Z_s}{MW}} = \frac{h_{red}}{q_{red}^2} \quad (3)$$

where reduced polytropic head ($h_{red}$) and reduced volumetric flow in suction squared ($q_{red}^2$) are defined as:

$$h_{red} = \frac{R_c^{\sigma}-1}{\sigma} \quad (4)$$

$$q_{red}^2 = \frac{\Delta P_o}{P_s} \quad (5)$$

All of these process variables are easily measured except the polytropic exponent ($\sigma$). However, this variable can be determined indirectly by using the following well known relationship between the temperature and compression ratios for polytropic processes:

$$R_\theta = R_c^{\sigma} \quad (6)$$

where:

$R_\theta$ is the temperature ratio across the compressor.

Note that when compressor performance is plotted in the coordinates reduced polytropic head ($h_{red}$) versus reduced volumetric flow in suction squared ($q_{red}^2$), the ratio of those variables defines the slope of a line from the origin through the operating point.

By normalizing this slope with respect to its value at the surge limit, which can be experimentally determined as a function of rotational speed and guide vane position, we arrive at a suitable, self-compensating, multi-variable parameter ($S_{rel}$) for measuring the position of the compressor operating point.

$$S_{rel} = f(N,\alpha) \times \frac{h_{red}}{q_{red}^2} \quad (7)$$

As the operating point approaches the surge limit, the value of this parameter will increase monotonically to unity (1) under any inlet and operating conditions. In addition, the time derivative (dS/dt) of this parameter provides a suitable measurement of the rate at which the operating point is approaching the surge limit. Both the desired margin of safety and the magnitude of the open-loop response can then be calculated as functions of this derivative.

Referring now to the drawings, FIG. 1 shows dynamic compressor 101 pumping gas from source 102 to end user 106. Gas enters the compressor through inlet line 103, into which is installed orifice plate 104, and leaves via discharge line 105. Excess flow is recycled to the source 102 via antisurge valve 107.

FIG. 1 also shows the antisurge control system and its connections to the compression process. This control system includes the rotational speed transmitter 108, guide vane position transmitter 109, inlet pressure transmitter 110, the discharge pressure transmitter 111, the inlet temperature transmitter 112, the discharge temperature transmitter 113, the flow rate transmitter 114 (which measures the differential pressure across the flow measuring device 104) and antisurge valve position transducer 115.

The control system also includes computing and control modules 116 through 135, as described in the following paragraphs.

Computing module 116 calculates the temperature ratio ($R_\theta$) of dynamic compressor 101 as as the ratio of discharge temperature ($T_d$) to suction temperature ($T_s$):

$$R_\theta = \frac{T_d}{T_s} \quad (8)$$

Analogously, computing module 117 calculates the compression ratio ($R_c$) as the ratio of discharge pressure ($P_d$) to suction pressure ($P_s$):

$$R_c = \frac{P_d}{P_s} \quad (9)$$

Module 118 then calculates the polytropic exponent ($\sigma$) using the following form of equation 6:

$$\sigma = \frac{\log R_\theta}{\log R_c} \quad (10)$$

Due to the relatively slow dynamics of temperature measuring devices, changes in the measured value of the temperature ratio ($R_\theta$) may lag behind those for the pressure ratio ($R_c$), thus producing spurious transients in the calculated value of the pOlytrOpic exponent ($\sigma$). This effect is countered by including lag control module 119, which filters the computed value of $\sigma$ to minimize the effects of slow temperature measurement dynamics.

Module 120 then calculates the reduced polytropic head $h_{red}$ of dynamic compressor 101 as a function of the compression ratio ($R_c$) and the polytropic exponent ($\sigma$), as defined by equation 4; module 121 calculates the reduced volumetric flow in suction squared ($q_{red}^2$) as a function of the differential pressure ($\Delta P_o$) and the inlet pressure ($P_s$) only, as defined by equation 5; and module 122 calculates the ratio of these two variables, which is the absolute slope ($S_{abs}$) of a line from the origin to the operating point when plotted in the COOrdinates $h_{red}$ vs $q_{red}^2$:

$$S_{abs} = \frac{h_{red}}{q_{red}^2} \quad (11)$$

The value of this slope at the surge limit ($S_{sl}$) can be programmed into the controller as an experimentally determined function of rotational speed (N) and guide vane position ($\alpha$). Module 123 then returns the value of this function under the measured operating conditions:

$$S_{sl} = f(N,\alpha) \quad (12)$$

Module 124 then calculates the relative slope of the line from the origin to the operating point by normalizing the absolute slope ($S_{abs}$) with respect to the slope of the surge limit ($S_{sl}$):

$$S_{rel} = \frac{S_{abs}}{S_{sl}} = \frac{h_{red}}{q_{red}^2 \times f(N,\alpha)} \quad (13)$$

Modules 125 through 127 calculate three variables which are used by both the closed- and open-loop response modules:

module 125 computes the relative distance ($d_{rel}$) between the operating point and the surge limit:

$$d_{rel}=1-S_{rel} \tag{14}$$

This variable is self-compensated for any variations of compressor efficiency, rotational speed, inlet conditions or gas composition;

module 128 calculates the rate ($v_{rel}$) at which the operating point is moving toward the surge limit by taking the time derivative of the relative slope ($S_{rel}$):

$$v_{rel}=\frac{dS_{rel}}{dt} \tag{15}$$

An increase in the value of this derivative will indicate that the operating point of the compressor is accelerating towards the surge limit; and module 127 calculates an added margin of safety ($b_3$) which is proportional to the number of surges detected by monitoring the compressor discharge pressure and feed rate signals for the sudden changes which characterize a surge cycle.

Modules 128 through 131 implement the controller's closed-loop response. Module 128 calculates the adaptive control bias ($b_2$) using either of two algorithms:

when the compressor operating point is moving toward the surge limit ($v_{rel}$ greater than zero), $b_2$ will be calculated as the greater of its previous value or a second value proportional to $v_{rel}$. Thus, $b_2$ will be held constant unless the operating point is accelerating toward the surge limit;

when the compressor operating point is moving away from the surge limit ($v_{rel}$ less than zero), $b_2$ will be slowly reduced to zero.

Module 129 then calculates the total margin of safety (b) by summing the steady-state bias ($b_1$), adaptive-control bias ($b_2$) and surge count bias ($b_3$), and comparator 130 calculates the deviation (e) between the resulting margin of safety (b) and the relative distance ($d_{rel}$) between the operating point and the surge limit:

$$e=d_{rel}-b \tag{16}$$

This deviation signal is then passed to the proportional-plus-integral control module (131), which will start to open the antisurge valve (107) when the distance ($d_{rel}$) between the operating point and the surge limit shrinks below the safe margin (b). Modules 132 through 134 implement the controller's open-loop response, which is triggered when the distance ($d_{rel}$) between the operating point and surge limit is less than a minimum threshold level ($d_t$). Summing module 132 computes the value of $d_t$ by adding the output ($b_3$) of the surge counter (module 127) to the operator supplied set point ($d_1$). Module 133 then generates a binary output indicating whether or not $d_{rel}$ is less than $d_t$, which is used to select the algorithm by which module 134 calculates the value of the open-loop response:

if $d_{rel}$ falls below $d_t$, module 134 immediately increments its output by an amount proportional to $v_{rel}$. Additional increments will be added at regular intervals ($t_c$ seconds) as long as $d_{rel}$ is less than $d_t$ and $v_{rel}$ is positive—if $v_{rel}$ is negative, the open-loop output Will be held constant;

if $d_{rel}$ is greater than $d_t$, module 134 slowly decreases the value of the open-loop response using an exponential decay algorithm.

Finally, summation module 135 computes the required antisurge valve position by adding the open-loop response from module 134 to the closed-loop response from module 131. This signal is then sent to transducer 115, which repositions antisurge valve 107 accordingly.

Figure 2:
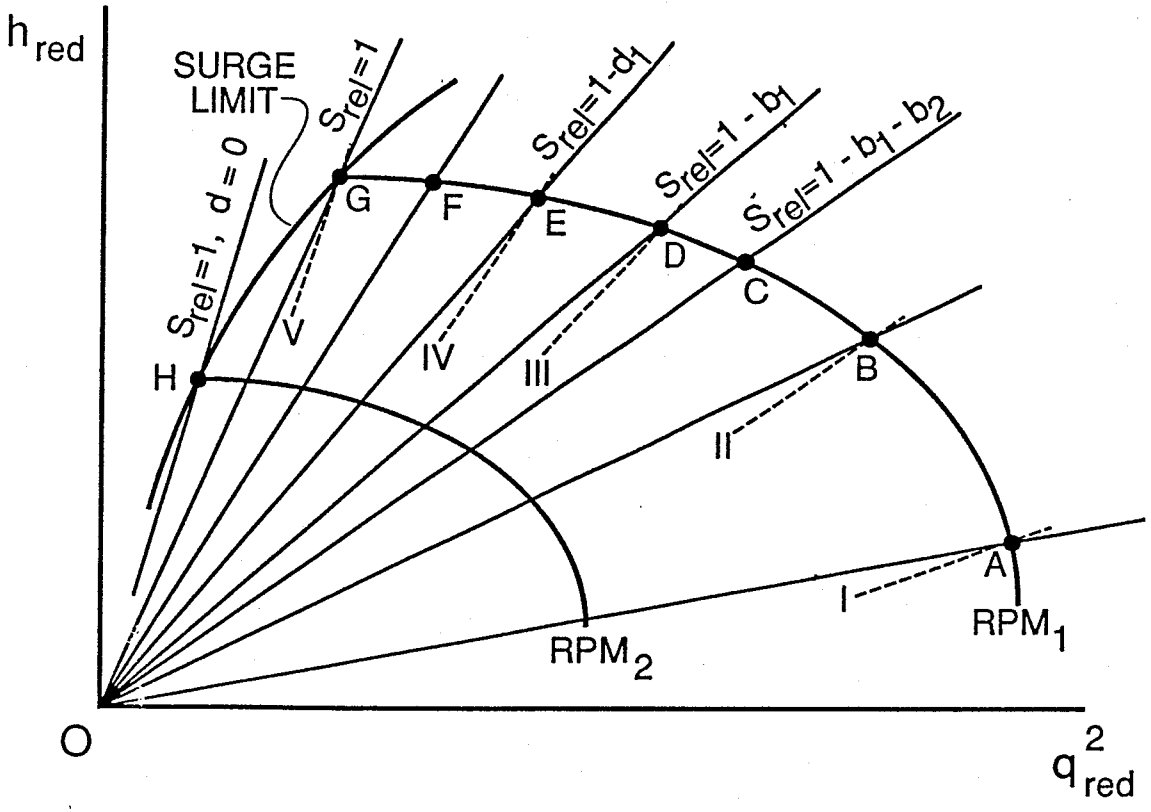
FIG. 2 is a compressor performance map which illustrates the operation of that surge protection system.

The operation of the control system diagrammed in FIG. 1 may be illustrated by the following example (see FIG. 2).

Assume that the dynamic compressor shown in FIG. 1 is initially operating at point A, which lies at the intersection of load curve I and the performance curve $RPM_1$. The value of $S_{rel}$ at this point is equal to the slope of line OA divided by the slope of line OG.

If the compressor is operating at steady-state and no surges have been detected since the surge counter was last reset, the set point for the controller's closed-loop response will correspond to point D, where the slope of line OD divided by the slope of line OG is equal to 1-$b_1$. Similarly the open-loop set point will be at point E, where the slope of line OE divided by the slope of line OG is equal to 1-$d_1$.

Now assume that a load change shifts the load curve from position I to position II, causing the operating point of the compressor to accelerate toward the surge limit. In response to this acceleration, adaptive control module 128 increases the margin of safety (b) by an amount $b_2$, thus moving the closed-loop set point to C. As the operating point approaches its new steady-state position at B, the rate of approaching surge ($v_{rel}$) will decrease, allowing the margin of safety to return to its normal level $b_1$ and the set point to return to D. The antisurge valve (107) stays closed because the operating point stabilizes at B without ever moving to the left of either the closed-loop or open-loop set point.

Now assume that this load change had instead moved the load curve from position I to position IV, which would still cause the operating point to accelerate toward the surge limit. In response to this acceleration, module 128 would still move the closed-loop set point toward some point such as C, but in this case the new steady-state operating point would probably lie to the left of point C. As soon as the operating point moves to the left of C, the proportional-plus-integral control module (131) begins opening the antisurge valve to increase the distance ($d_{rel}$) between the operating point and the surge limit back up to the margin of safety (b). As a result of the valve opening, the overall load curve will move back toward position III, so the operating point will probably stabilize before reaching the open-loop set point E.

As soon as the speed of approaching surge ($v_{rel}$) decreases to zero, the operating point will move back to the right and the set point will slowly return to its steady-state position D. The antisurge valve (107) will stabilize at whatever position is needed to keep the load curve at or to the right of position III, allowing the operating point to stabilize at or to the right of point D, where the distance ($d_{rel}$) between the operating point and the surge limit is at least as large as the steady state margin of safety ($b_1$).

Finally, assume that an even larger disturbance suddenly shifts the load curve from position I to position V. In this case, the closed-loop response will probably fail to prevent the operating point from moving to the left of the open-loop set point at E. As soon as the operating point moves to the left of E, the open-loop control module (134) will increase the antisurge valve opening by an amount proportional to the rate ($v_{rel}$) at which the operating point is approaching the surge limit.

Assume that the operating point continues to move toward the surge limit for another $t_c$ seconds, at which time it is passing point F. Module 134 will then increase the opening of the antisurge valve by a second increment $C_2$, which will be proportional to the derivative of $S_{rel}$ at that point. Due to the control actions already taken, $v_{rel}$ will presumably be smaller at point F than it was at the point E. Thus, the second increment ($C_2$) should be smaller than the first ($C_1$).

Once the antisurge valve has been opened far enough to reduce the speed of approaching surge to zero, module 134 will stop adding adaptive increments to the valve opening. Although the accumulated open-loop response then decays slowly to zero, the proportional-plus-integral module (131) will continue to increase the valve opening until the load curve returns to position IV. This restores the operating point to position D, where the distance ($d_{rel}$) between the operating point and the surge limit is once again equal to the steady state level $b_1$ of the safety margin (b).

If the compressor rotational speed slows from $RPM_1$ to $RPM_2$, module 123 automatically recomputes the slope of the line through the surge limit point, thus allowing the distance ($d_{rel}$) between the operating point and the surge limit to be calculated relative to the slope of a line through the new surge limit point H. Module 123 will also automatically compensate for changes in the position of any guide vanes. Because any movement of the operating point due to changing gas composition or polytropic efficiency will be reflected in the computed value of $S_{rel}$, this method will be self-adjusting for all such Changes.

The particular combination of closed-loop and open-loop control detailed above tailors both responses to the magnitude of each individual disturbance by employing control responses which are dependent on the derivative of the controlled variable in a way that does not produce unneeded valve movements and satisfies the conditions of stability without requiring larger margins of safety.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

We claim:

1. A method of anti-surge protection for a dynamic compressor having a corresponding compressor performance map and inlet and discharge networks, an anti-surge valve connecting said discharge and inlet networks and an anti-surge control system operating said anti-surge control valve to maintain the relative distance between the compressor operating point and the surge limit below which said compressor would surge, said relative distance being a difference between the relative operating slope of the compressor and the relative slope of the surge limit, both of said relative slopes being ratios of the actual slopes to the slope of the surge limit line, both actual slopes being tangents of the angles between the operating point and the horizontal axis of the compressor performance map and the surge limit and the horizontal axis of the compressor performance map, said method comprising:

continuously calculating said relative distance between the compressor operating point and the surge limit as a function of one or more measured process variables and adjusting the position of said anti-surge valve by a closed loop response of the control system to prevent said relative distance between the compressor operating point and the surge limit from decreasing below a minimum margin of safety, said margin of safety including both constant and variable parts; and maintaining said variable part at zero under steady-state conditions, increasing said variable part when said operating point approaches said surge limit at an increasing rate, and slowly decreasing said variable part toward zero when the rate of approaching surge decreases.

2. A method of anti-surge protection for a dynamic compressor having a corresponding compressor performance map and inlet and discharge networks, an anti-surge valve connecting said discharge and inlet networks and an anti-surge control system operating said anti-surge control valve to maintain the relative distance between the compressor operating point and the surge limit below which said compressor would surge, said relative distance being a difference between the relative operating slope of the compressor and the relative slope of the surge limit, both of said relative slopes being ratios of the actual slopes to the slope of the surge limit line, both actual slopes being tangents of the angles between the operating point and the horizontal axis of the compressor performance map and the surge limit and the horizontal axis of the compressor performance map, said method comprising:

continuously calculating said relative distance between the compressor operating point and the surge limit as a function of one or more measured process variables and adjusting the position of said anti-surge valve by a closed loop response of the control system to prevent said relative distance between the compressor operating point and the surge limit from decreasing below a minimum margin of safety, said minimum margin of safety including both constant and variable parts, and adding an open-loop response to the output of said anti-surge control system whenever the relative distance between the compressor operating point and the surge limit is below some preset level of danger because when said relative distance between the compressor operating point and the surge limit is located below said preset level of danger, the operating point may cross the surge limit line; and maintaining said open-loop response at zero under steadystate conditions, increasing said open-loop response by an amount proportional to the instantaneous rate at which said controlled variable is approaching said surge limit whenever the relative distance between the compressor operating point and the surge limit decreases below the preset level of danger, and at preset time intervals thereafter so long as said relative distance between the compressor operating point and the surge limit continues to be below said preset level of danger, and decreasing said open-loop response slowly toward zero whenever said relative distance between the operating point and the surge limit becomes higher than the preset level of danger.

3. The method of claim 2, further comprising:

continuously manipulating the position of the anti-surge valve to adjust the output of said anti-surge control system to maintain the relative distance between the compressor operating point and the surge limit above the minimum margin of safety, said margin of safety consisting of both constant and variable parts, maintaining said variable part at zero under steady-state conditions, increasing said variable part when said operating point approaches said surge limit at an increasing rate, and slowly decreasing said variable part when the rate of approaching surge decreases;

adding an open-loop response to the output of said antisurge control system whenever said relative distance between the compressor operating point and the surge limit is beyond said surge limit;

maintaining said open-loop response at zero under steadystate conditions, increasing said open-loop response by an amount proportional to the instantaneous rate at which said controlled variable of said closed-loop response in approaching the surge limit of said closed-loop response whenever the relative distance between the compressor operating point and said surge limit decreases below the preset level of danger, and at preset time intervals thereafter so long as said relative distance between the compressor operating point and the surge limit continues to be below said preset level of danger, and decreasing said open-loop response slowly toward zero whenever said relative distance between the compressor operating point of the surge limit and said surge limit becomes higher than the preset level of danger; and increasing one of (a) the closed-loop margin of safety and (b) the level of danger whenever rapid drops are detected in one of (a) the flow rate through said compressor and (b) the discharge pressure of said compressor.

4. A method of anti-surge protection for a dynamic compressor having inlet and discharge networks, an anti-surge valve connecting said discharge and inlet networks and an anti-surge control system operating said anti-surge control valve to maintain the gas flow rate through said compressor above a surge limit below which said compressor would surge, said surge limit being a function of several process variables, said method comprising:

continuously measuring the suction pressure, suction temperature, discharge pressure and discharge temperature of said compressor, calculating the temperature ratio by dividing the discharge temperature by the suction temperature, calculating the pressure ratio by dividing the discharge pressure by the suction pressure, and calculating the polytropic exponent of said compressor by dividing the logarithm of said temperature ratio by the logarithm of said compression ratio;

continuously calculating the reduced polytropic head of said compressor by raising said compressor ratio to a power determined by said polytropic exponent, reducing the result by 1, and dividing the remainder by said polytropic exponent;

continuously measuring the pressure drop across a flow rate measuring device, and calculating the reduced volumetric flow in suction squared by dividing said pressure drop by said suction pressure;

continuously calculating said operating slope of the compressor as the ratio of said reduced polytropic head to said reduced volumetric feed rate squared;

continuously calculating said slope of the surge limit as a function of the measured or constant rotational speed and the measured or constant guide vane position of said compressor;

continuously calculating said relative operating slope as a ratio of said slope of said operating point to said slope of the surge limit;

continuously calculating the relative distance between the compressor operating point and the surge limit between the operating point and surge as a difference between a relative slope of surge being equal to one and the relative operating slope of the compressor's operating point; and continuously manipulating the position of said anti-surge valve by adjusting the output of said anti-surge control system to prevent said relative distance between the compressor operating point and the surge limit from decreasing below a predetermined margin of safety.

* * * * *